US006061976A

United States Patent [19]

Willbanks, Jr.

[11] Patent Number: 6,061,976

[45] Date of Patent: May 16, 2000

[54] PROTECTIVE SHELTER

[75] Inventor: John D. Willbanks, Jr., Colleyville, Tex.

[73] Assignee: Storm Chaser Shelters, Inc., Ft. Worth, Tex.

[21] Appl. No.: 09/166,662

[22] Filed: Oct. 5, 1998

[51] Int. Cl.[7] ..... E04H 7/00

[52] U.S. Cl. ..... 52/169.6; 52/169.1

[58] Field of Search ..... 52/169.1, 169.6, 52/79.1, 79.4, 19

[56] References Cited

U.S. PATENT DOCUMENTS

| | | | |
|---|---|---|---|
| 984,942 | 2/1911 | Leddy . | |
| 2,871,802 | 2/1959 | Fishler . | |
| 3,049,835 | 8/1962 | Sundstrum . | |
| 3,173,387 | 3/1965 | Cree, Jr. . | |
| 4,534,144 | 8/1985 | Gustafsson | 52/169.6 |
| 4,539,780 | 9/1985 | Rice | 52/169.6 |
| 5,022,202 | 6/1991 | Johnson | 52/169.6 |
| 5,263,298 | 11/1993 | Ballesteros | 52/169.6 X |
| 5,542,780 | 8/1996 | Kourgli | 52/169.6 X |
| 5,829,208 | 11/1998 | Townley | 52/169.6 |

*Primary Examiner*—Beth A. Stephan
*Attorney, Agent, or Firm*—Charles D. Gunter, Jr.

[57] ABSTRACT

A protective shelter is shown which is installed at least partly in the surrounding earth. The shelter has a metal body with a top, bottom, opposing end walls and opposing sidewalls. The sidewalls of the body are slanted outwardly so as to create a flared bottom region which assists in retaining the body in an installed location with the surrounding earth. A horizontal rib, located on the body exterior at the approximate juncture of the top region and bottom region serves to add structural strength to the body and presents a protuberance which can be set in the earth to further assist in retaining the body in the installed location. An internal bulkhead within the closed interior of the structure provides further structural integrity and protects against falling or crushing loads.

17 Claims, 2 Drawing Sheets

PROTECTIVE SHELTER

BACKGROUND OF THE INVENTION

1. Field of the Invention

The present invention relates to underground or partially underground shelters and, specifically, to a safe, waterproof protective shelter especially adapted to provide protection in the case of severe weather.

2. Description of the Prior Art

Natural disasters, such as tornadoes and other severe atmospheric disturbances, continue to take an enormous toll of human life each year. One of the most dreadful disasters which can occur is a tornado striking a thickly populated area without warning. Certain types of urban dwelling environments, such as mobile home parks, are especially susceptible to damage from high winds, water, hail and other naturally occurring phenomenon. Despite advances in electronic warning systems, radar, public safety and National Weather Service alerts, there is often insufficient time for affected individuals to be able to evacuate from the path of an oncoming storm. One way to protect individuals in harms way is to provide underground or partially underground shelters in the immediate vicinity of the dwelling.

During the Cold War era, as conventional underground shelters were adapted for general civilian usage, a number of concrete and reinforced concrete structures were devised which were typically scaled-down from the size designed for military usage to accommodate an average family. These structures were not watertight and were often damp with the air being fowled by the damp atmosphere. Providing the necessary excavation and construction of a concrete structure was time consuming and less than economical. With the scaling down of Cold War concerns, few if any fall-out shelters have been built in civilian areas in modern times.

Recent tendencies to erect homes having no basement and a slab floor emphasize the need for alternative protective shelters in the event of natural disaster, severe weather and other emergencies.

It is accordingly an object of the present invention to provide a prefabricated protective shelter which is completely assembled and ready for installation upon preparation of a suitable opening in the surrounding earth which will protect affected individuals in the path of a storm or severe weather conditions.

Another object of the invention is to provide such a protective shelter which is capable of economical mass assembly and which employs a structure which is reinforced against damage and which is sound against water leakage.

Another object of the invention is to provide a protective shelter fabricated from metal which is watertight and yet which is adequately anchored in the surrounding earth to prevent the shelter from being floated away in the event of flood, heavy rains or other natural disaster.

Another object of the invention is to provide such a prefabricated structure of a corrosion resistant metal which, when embedded in the ground, will be securely anchored therein and held against forces tending to work the structure loose.

SUMMARY OF THE INVENTION

The protective shelter of the invention is installed at least partly in surrounding earth. The shelter includes a metal body having a top, a bottom and opposing end walls and opposing sidewalls which together create a body exterior and an enclosed interior communicated with by means of a door opening. The enclosed interior is divided into a top region and a bottom region. The opposing sidewalls are slanted outwardly in the direction of the bottom region from an upper vertical location to a lower vertical location thereof, thereby creating a flared bottom region which assists in retaining the body in an installed location within the surrounding earth. A horizontal rib is preferably located on the body exterior at the approximate juncture of the top region and bottom region of the body. The rib serves to add structural strength to the body and presents a protuberance which can be set in the earth to further assist in retaining the body in the installed location. Preferably, the body is formed of galvanized sheet metal with portions thereof being welded together to form a watertight enclosure.

The enclosed interior of the body is provided with at least one vertically arranged bulkhead or baffle plate located between the opposing end walls of the enclosed interior and dividing the enclosed interior into a front chamber and a rear chamber. The baffle plate has a door opening therein which communicates between the front chamber and rear chamber. The vertically arranged baffle plate preferably includes an exposed portion which extends through an opening in the body to the exterior thereof. The exposed portion is provided with an attachment point for lifting the body during installation and transportation procedures. Preferably, the vertically arranged baffle plate is located on the approximate center of gravity of the body and is approximately balanced when lifted by the attachment point.

The door opening to the body can be connected to an opening in an end wall thereof by means of a stairwell. A hinged door covers the door opening at the top of the stairwell and is pivoted about the hinge by means of a hydraulic cylinder. In the preferred shelter, the bottom region is stepped inwardly to form a foot region and oppositely arranged internal ledges. The bottom region of the enclosed interior generally forms a T-shaped cross-section when viewed from opposing end walls thereof. A roof vent or other convenient openings can be provided to provide sufficient ventilation to the structure.

Additional objects, features and advantages will be apparent in the written description which follows.

DESCRIPTION OF THE INVENTION

Figure 1:
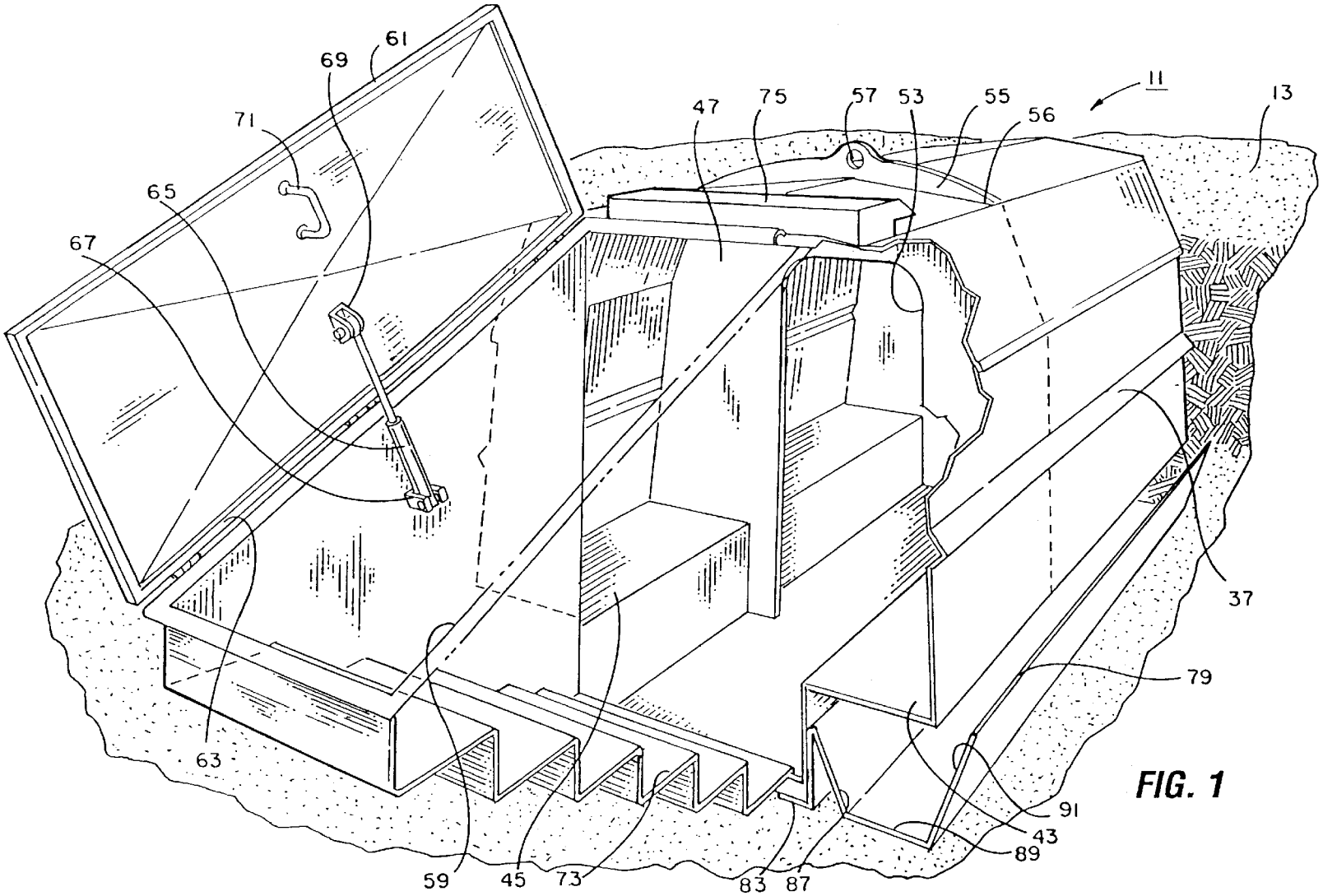
FIG. 1 is a perspective view of the protective shelter of the invention, shown partly broken away and partly received within a surrounding subterranean earthen formation.
Figure 2:
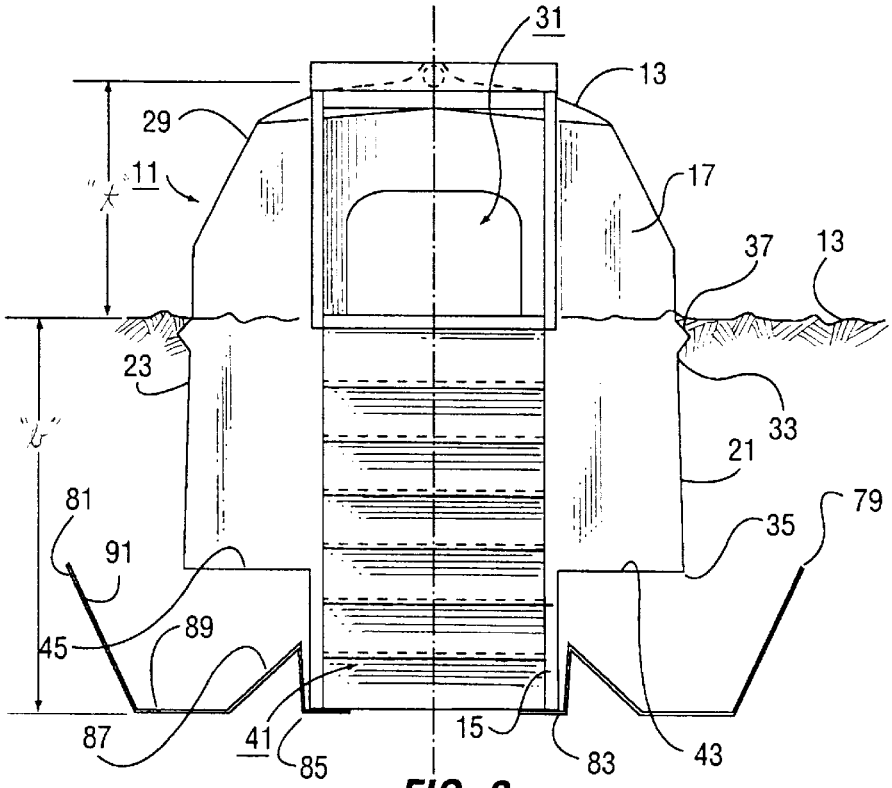
FIG. 2 is an end view of the device of FIG. 1 with the door closed and the downwardly extending stairwell being shown in dotted lines.

FIGS. 1 and 2 show a protective shelter of the invention designated generally as 11. The shelter 11 is shown installed at least partly within the surrounding earthen formation 13. The shelter is comprised of a metal body, preferably fabricated from galvanized sheet metal with portions welded together to form a watertight enclosure. The metal body has a top 13, a bottom 15, opposing end walls 17, 19 (see FIGS. 2 and 3) and opposing sidewalls 21, 23. The front end wall 17 communicates with the body exterior by means of a door opening 25 (FIG. 3) and a stairwell 27. The top, bottom, opposing end walls and opposing sidewalls together create a body exterior 29 and a body interior 31 with the enclosed interior 31 being divided generally into a top region "t" and a bottom region "b" (FIG. 2).

As best seen in FIG. 2, the opposing sidewalls 21, 23 are slanted outwardly in the direction of the bottom region from an upper vertical location 33 to a lower vertical location 35, thereby creating a flared bottom region which assists in retaining the body in an installed location within the surrounding earth.

Figure 3:
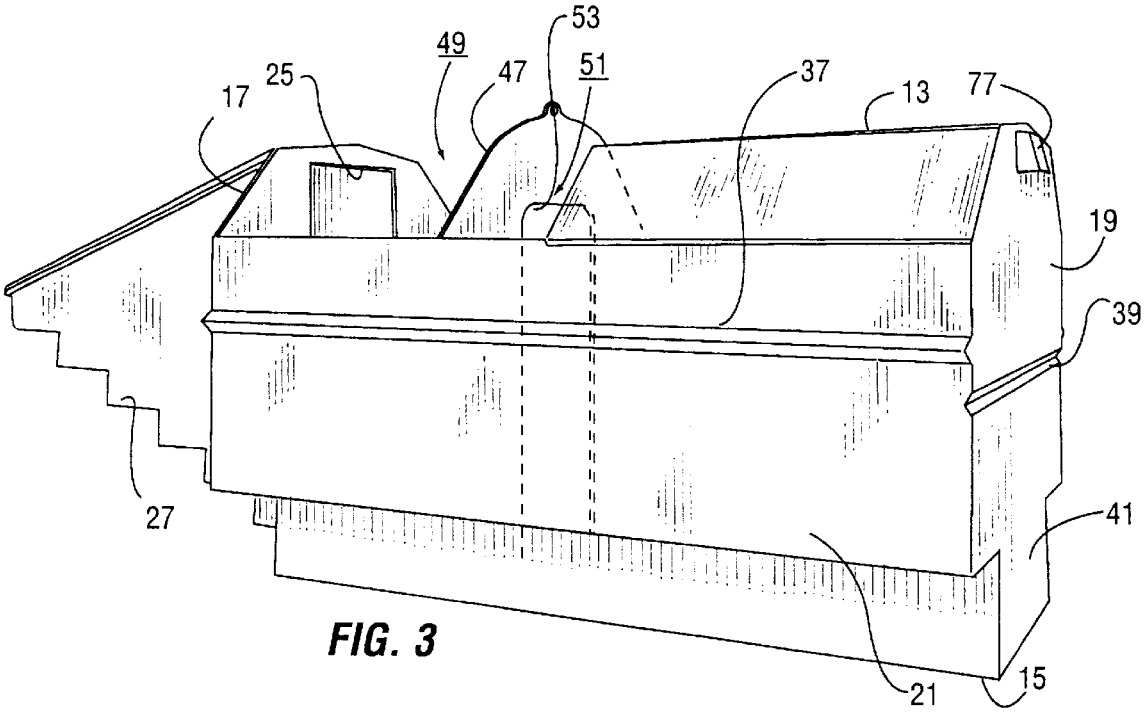
FIG. 3 is a side, isolated view of the protective shelter of the invention with portions of the top region removed for ease of illustration.

As shown in FIGS. 1–3, a horizontal rib 37 is located on the body exterior at the approximate juncture of the top region "t" and the bottom region "b" of the body. The rib 37, in the embodiment shown runs along the opposing sidewalls 21, 23. If desired, an additional rib 39 can be provided in the rear wall 19 (FIG. 3). The horizontal ribs 37 which run along the sidewalls 21, 23 serve to add structural strength to the body and present a protuberance which is located at approximately the surface of the earth and, as shown in FIG. 2, can be set in the earth to further assist in retaining the body in the installed location.

Preferably, the body is fabricated from a sheet metal such as steel and the horizontal ribs 37 are integrally formed therein, as by stamping or forming. Alternatively, the opposing sidewalls can be formed of sheet metal and the horizontal ribs can be affixed to the exterior thereof, as by welding.

As shown in FIG. 2, the bottom region of the enclosed interior 31 forms a generally T-shaped cross-section when viewed from the opposing end walls thereof. The T-shaped cross-sect ion defines a foot region 41 which separates a pair of oppositely arranged horizontal ledges 43, 45. The ledges 43, 45 can serve as seats for the occupants of the shelter during a storm.

As best seen in FIGS. 1 and 3, a vertically arranged baffle plate or bulkhead 47 is located between the opposing end walls 17, 19 of the enclosed interior and divides the enclosed interior into a front chamber 49 and a rear chamber 51. The baffle plate has a door opening 53 therein which communicates between the front chamber 49 and the rear chamber 51. As shown in FIGS. 1 and 3, the vertically arranged baffle plate 47 forms a bulkhead type structure within the closed interior of the shelter, adding structural rigidity and protection against falling or crushing loads. A door can be affixed to cover the opening in the baffle to create a high security chamber, if desired. Preferably, the vertically arranged baffle plate 47 has an exposed portion 55 which extends through an opening 56 in the top of the body to the exterior thereof. The exposed portion 55, as shown in FIG. 1, is provided with an attachment point 57 which can be used to lift the shelter by means of a crane or other piece of equipment during transportation and installation procedures. Since the baffle plate 47 is located at the approximate center of gravity of the shelter, the body is approximately balanced when lifted by the attachment point 57.

As shown in FIG. 1, the door opening 59 to the closed interior is covered by a hinged door 61 the door being pivotable about the hinge line 63 by means of a hydraulic cylinder 65 which is fixed at a first point 67 and which is connected by means of an output shaft with a second attachment point 69. An internal handle 71 also assists the user in opening and closing the door from the inside of the shelter.

The door opening 59, as shown in FIG. 1, communicates with the enclosed space of the shelter by means of a downwardly extending stairwell and a plurality of stairs 73.

At least one roof vent partly covered by a protective element 75 (FIG. 1) provides ventilation to the enclosed structure. As shown in FIG. 3, an end vent 77 may be provided in the end wall 19 to assist in the ventilation of the structure.

As shown in FIG. 2, a pair of opposing wings 79, 81 are each provided with a connection point 83, 85 for connection to the bottom 15 of the shelter. Each wing 79, 81 includes an inner slanting sidewall 87, a bottom wall 89 and an outer slanting sidewall 91. Together, the walls of each respective wing form a trough for receiving ballast whereby the troughs can be backfilled to assist in retaining the structure in the installation location and preventing the structure from floating in the case of flood or high water.

To install the protective shelter of the invention, the prefabricated structure is delivered to the vicinity of the affected dwelling or dwellings. For example, one shelter might be provided for each 5–15 mobile homes in a mobile home park or apartment dwelling. An opening of sufficient size is then excavated in the earthen terrain, the "wings" (if utilized) are set in place and the shelter itself is lowered into position in the excavation by means of the attachment point of the bulkhead. Ballast is then typically installed in the "trough" of the wings and earth is backfilled against the flared sidewalls of the structure. Alternatively, the structure can be set on or within a concrete foundation or footing poured within the excavation. Earth is then used to fill the excavation to the approximate fill line of the horizontal rib on the structure sidewalls, leaving the roof vent and end vent as well as the door opening uncovered.

An invention has been provided with several advantages. The protective shelter of the invention utilizes an internal baffle which allows for increased strength and structural integrity. An external rib further reinforces the structure. The shelter is preferably formed from sheet metal and is welded together to provide a leak proof enclosure which does not seep or become moist. The structure has external sidewalls which are selectively contoured to provide an intentional backfill which prevents the structure from being easily removed from the subterranean location. Thus, the structure can be provided with a watertight construction without the danger of floating away in floods or high water. The door and stairwell provide convenient accessibility and ventilation features provide adequate ventilation for the interior. A number of individuals can be accommodated per shelter, enabling multiple family dwellings, such as mobile home parks, to take advantages of the design. Providing the metallic body of galvanized steel provides a corrosion resistant structure which is not prone to deterioration in the elements.

While the invention has been shown in only one of its forms, it is not thus limited but is susceptible to various changes and modifications without departing from the spirit thereof.

What is claimed is:

1. A protective shelter installed at least partly in surrounding earth, the shelter comprising:

a metal body having a top, a bottom, opposing end walls and opposing side walls which together create a body exterior and an enclosed interior communicated with by means of a door opening, the enclosed interior being divided into a top region and a bottom region;

wherein the opposing side walls are slanted outwardly in the direction of the bottom region from the top to the bottom of the metal body, thereby creating a flared bottom region which assists in retaining the body in an installed location within the surrounding earth; and wherein a horizontal rib is located on the body exterior at the approximate juncture of the top region and the bottom region of the body, the rib serving to add structural strength to the body and presenting a protuberance which can be set in the earth to further assist in retaining the body in the installed location.

2. The protective shelter of claim 1, wherein the opposing side walls are formed of sheet metal and wherein the horizontal rib is integrally formed therein.

3. The protective shelter of claim 1, wherein the opposing side walls are formed of sheet metal and wherein the horizontal rib is affixed to the exterior thereof by welding.

4. The protective shelter of claim 1, wherein the bottom region of the enclosed interior forms a generally T-shaped cross section when viewed from opposing end walls thereof, the T-shaped cross section defining a foot region separating a pair of oppositely arranged horizontal ledges.

5. The protective shelter of claim 1, wherein the body is formed of galvanized sheet metal with portions thereof being welded together to form a water tight enclosure.

6. A protective shelter installed at least partly in surrounding earth, the shelter comprising:

a metal body having a top, a bottom, opposing end walls and opposing side walls which together create a body exterior and an enclosed interior communicated with by means of a door opening, the enclosed interior being divided into a top region and a bottom region;

wherein the opposing side walls are slanted outwardly in the direction of the bottom region from the top to the bottom of the metal body, thereby creating a flared bottom region which assists in retaining the body in an installed location within the surrounding earth; and wherein the enclosed interior of the body includes at least one vertically arranged baffle plate located between the opposing end walls of the enclosed interior and dividing the enclosed interior into a front chamber and a rear chamber, the baffle plate having a door opening therein which communicates between the front chamber and the rear chamber.

7. The protective shelter of claim 6, wherein a horizontal rib is located on the body exterior at the approximate juncture of the top region and the bottom region of the body, the rib serving to add structural strength to the body and presenting a protuberance which can be covered with earth to further assist in retaining the body in the installed location.

8. The protective shelter of claim 7, wherein the opposing side walls are formed of sheet metal and wherein the horizontal rib is integrally formed therein.

9. The protective shelter of claim 7, wherein the opposing side walls are formed of sheet metal and wherein the horizontal rib is affixed to the exterior thereof by welding.

10. The protective shelter of claim 6, wherein the bottom region of the enclosed interior forms a generally T-shaped cross section when viewed from opposing end walls thereof, the T-shaped cross section defining a foot region separating a pair of oppositely arranged horizontal ledges.

11. The protective shelter of claim 6, wherein the vertically arranged baffle plate has an exposed portion which extends through an opening in the body to the exterior thereof, the exposed portion being provided with an attachment point for lifting the body during the installation procedure.

12. The protective shelter of claim 11, wherein the vertically arranged baffle plate is located on the approximate center of gravity of the body is approximately balanced when lifted by the attachment point.

13. The protective shelter of claim 6, further comprising:

at least one roof vent on the top of the body, the roof vent being partly covered by a protective element.

14. The protective shelter of claim 6, wherein the body is formed of galvanized sheet metal with portions thereof being welded together to form a water tight enclosure.

15. The protective shelter of claim 6, wherein the door opening in the body is connected to an opening in an end wall thereof by means of a stairwell.

16. A storm shelter installed at least partly in surrounding earth for protection during violent weather, the shelter comprising:

a metal body having a top, a bottom, opposing end walls and opposing side walls which together create a body exterior and an enclosed interior communicated with by means of a door opening, the enclosed interior being divided into a top region and a bottom region;

wherein the opposing side walls are slanted outwardly in the direction of the bottom region from the top to the bottom of the metal body, thereby creating a flared bottom region which assists in retaining the body in an installed location by backfilling against the flared bottom region as the body is installed within the surrounding earth; and wherein the enclosed interior of the body includes at least one vertically arranged baffle plate located between the opposing end walls of the enclosed interior at an approximate center of gravity for the body and dividing the enclosed interior into a front chamber and a rear chamber, the baffle plate having a door opening therein which communicates between the front chamber and the rear chamber, the vertically arranged baffle plate having an exposed portion which extends through an opening in the body to the exterior thereof, the exposed portion being provided with an attachment point for lifting the body during the installation procedure;

wherein a horizontal rib is located on the body exterior at the approximate juncture of the top region and the bottom region of the body, the rib serving to add structural strength to the body and presenting a protuberance which can be covered with earth to further assist in retaining the body in the installed location.

17. The storm shelter of claim 16, further comprising:

a pair of wing elements, each wing element being connected to an opposing side wall of the bottom region of the body and extending outwardly therefrom, each wing element having an inner slanted wall portion, a bottom wall, and an outwardly slanted wall portion which together form a trough for receiving ballast to further hold down and secure the body in the installed location.

* * * * *